US009010286B2

(12) United States Patent
Novak

(10) Patent No.: US 9,010,286 B2
(45) Date of Patent: Apr. 21, 2015

(54) INTERNAL COMBUSTION ENGINE AND COMPRESSOR OR PUMP WITH ROTOR AND PISTON CONSTRUCTION, AND ELECTRICAL GENERATOR PNEUMATICALLY DRIVEN BY SAME

(71) Applicant: Robert J. Novak, Regina (CA)

(72) Inventor: Robert J. Novak, Regina (CA)

( * ) Notice: Subject to any disclaimer, the term of this patent is extended or adjusted under 35 U.S.C. 154(b) by 92 days.

(21) Appl. No.: 13/746,047

(22) Filed: Jan. 21, 2013

(65) Prior Publication Data

US 2013/0186084 A1 Jul. 25, 2013

Related U.S. Application Data

(60) Provisional application No. 61/589,971, filed on Jan. 24, 2012.

(51) Int. Cl.

| | |
|---|---|
| ***F02B 57/08*** | (2006.01) |
| ***F01B 13/06*** | (2006.01) |
| ***F01B 13/04*** | (2006.01) |
| ***F02B 57/00*** | (2006.01) |
| ***F02B 63/04*** | (2006.01) |

(52) U.S. Cl.
CPC ..... *F02B 63/042* (2013.01); *F01B 13/045* (2013.01); *F02B 57/00* (2013.01)

(58) Field of Classification Search
CPC ..... F02B 57/00; F02B 63/042; F01B 13/045
USPC ..... 123/44 R, 44 D, 43 C, 43 R, 193.6
See application file for complete search history.

(56) References Cited

U.S. PATENT DOCUMENTS 2,775,493 A * 12/1956 Cheney ..... 123/193.6
5,375,564 A * 12/1994 Gail ..... 123/44 D (Continued)

FOREIGN PATENT DOCUMENTS

EP 0394763 A1 * 10/1990 ..... F02B 57/08
FR 2229274 A5 * 12/1974 ..... F02B 57/00

(Continued)

OTHER PUBLICATIONS

Machine generated translation of KR 100680558 B1 attached, published on Feb. 2, 2007.*

(Continued)

*Primary Examiner* — Thai Ba Trieu
*Assistant Examiner* — Ngoc T Nguyen
(74) *Attorney, Agent, or Firm* — Kyle R. Satterthwaite; Ryan W. Dupius; Ade & Company Inc.

(57) ABSTRACT

Unique engines, air compressors, and pneumatically driven electrical generators are disclosed. The engine employs a rotor having a number of pistons slidably disposed within respective cylinder bores extending into the rotor periphery. As the rotor spins within a stator, each cylinder bore passes a combustion stage at which the piston is driven further into the rotor toward a bottom of the respective cylinder bore. Valves at the bottom of the cylinder discharge air that is compressed by this piston downstroke, and admit new intake air during an opposing upstroke. The unit thus operates as a self driven compressor, or engine-compressor combination, and the compressed air may be used to pneumatically drive a turbine of an electrical generator. A carbon splitter dissociates carbon and oxygen molecules from the carbon dioxide in the air downstream of the generator turbine, reducing the overall carbon dioxide output of the system.

17 Claims, 14 Drawing Sheets

(56) References Cited

U.S. PATENT DOCUMENTS

| | | | | |
|---|---|---|---|---|
| 5,544,484 | A * | 8/1996 | Voss et al. | 60/397 |
| 6,164,263 | A | 12/2000 | Saint-Hilaire et al. | |
| 6,725,646 | B2 * | 4/2004 | Callas et al. | 60/247 |
| 8,511,060 | B1 * | 8/2013 | Watts | 123/44 D |

FOREIGN PATENT DOCUMENTS

| | | | | |
|---|---|---|---|---|
| FR | 2413550 | B1 * | 10/1980 | F02B 57/00 |
| KR | 100680558 | B1 * | 2/2007 | F02B 57/00 |
| WO | WO 8301091 | A1 * | 3/1983 | F02B 57/00 |
| WO | WO 9402725 | A1 * | 2/1994 | F02B 57/00 |
| WO | WO 2008037352 | A1 * | 4/2008 | F02B 57/00 |

OTHER PUBLICATIONS

Machine generated translation of WO 2008037352 A1 attached, published on Apr. 3, 2008.*

* cited by examiner 626
628
604'
622
606
624
614
612
609'
620'
608'
610
616
604

INTERNAL COMBUSTION ENGINE AND COMPRESSOR OR PUMP WITH ROTOR AND PISTON CONSTRUCTION, AND ELECTRICAL GENERATOR PNEUMATICALLY DRIVEN BY SAME

FIELD OF THE INVENTION

The present invention relates generally to internal combustion engines, and more particularly to an internal combustion engine with a novel design in which a plurality pistons reciprocate within a spinning rotor to drive rotation of an output shaft or pump or compress a fluid.

BACKGROUND OF THE INVENTION

Modern internal combustion engines use a four stage cycle to obtain power for rotational motion from the ignition of a combustible fuel, such as gasoline. The first stage is intake wherein a mixture of air and fuel is introduced into a combustion chamber. The second stage is the compression of this mixture within the combustion chamber in preparation for the next stage, the power stage. In the power, or combustion stage, the compressed air and fuel mixture is ignited and the combustion rapidly increased the pressure within the combustion chamber. This pressure is exerted on a movable mechanical part, for example a linearly displaceable piston or a rotatable rotor, to harness power by capturing motion of this movable part. The final fourth stage is the exhausting of gases remaining in the combustion chamber.

Reciprocating type or piston-based engines involve the reciprocation of one or more pistons within a respective cylinder. The pistons are pivotally connected to a crankshaft to convert their linear motion into typically more useful rotational motion. A full rotation of the crankshaft corresponds to two complete strokes of a piston within its cylinder. In a four-stroke engine, a piston completes one combustion cycle for every two rotations of the crankshaft. A two-stroke engine completes its combustion cycle once every crankshaft rotation, but such engines are generally considered to be less efficient and create more pollution.

Rotary combustion engines involve rotational motion of a rotor within a stator instead of reciprocating motion of a piston within a cylinder. Such engines may benefit from a higher power to weight ratio, lower mechanical complexity and vibration reduction when compared to reciprocating engines.

A Wankel engine is a rotary combustion engine featuring a three-sided rotor arranged for planetary motion within an epitrochoid housing. The corners and faces of the rotor seal against the housing to divide its interior into three combustion chambers, each of which carries out four stages of the combustion cycle per rotor rotation for a total of twelve stages. However, the rotor rotates once for every three rotations of an output driveshaft, resulting in four completed stages of the combustion cycle per output rotation, the same as a two-stoke reciprocating engine piston and more than the four-stroke engine pistons typically used in automobiles.

A quasiturbine engine (U.S. Pat. No. 6,164,263) is a rotary combustion engine featuring a four-sided rhomboid rotor with its sides hinged at the corners. Similar to the Wankel engine, the corners and faces of the rotor seal against an oval-like housing like, but four chambers are created instead of three due to the four-sided rotor. However, the rotor turns at the same rate as the output driveshaft and therefore carries out sixteen completed stages of the combustion cycle per output rotation.

Due in part to current concerns regarding depletion of the world's finite supply of fossil fuels and detrimental effects to the environment associated with use of these fuels, there is a large desire to develop more fuel efficient and environmentally friendly alternatives to conventional internal combustion engines.

With this in mind, Applicant has designed a new internal combustion engine with a unique combination of elements not before seen by the Applicant.

SUMMARY OF THE INVENTION

According to a first aspect of the invention there is provided an internal combustion engine comprising:

a stationary stator defining a cylindrical interior of circular cross section;

a cylindrical rotor of circular cross section supported within the stator interior for rotation with a drive shaft projecting from the stator along a central axis, the rotor having a plurality of cylindrical bores extending thereinto from a periphery thereof at angularly spaced positions about the driveshaft, the cylindrical bores being oriented and positioned with respect to radii of the rotor to dispose an inner end of each bore forward of an outer end thereof in the predetermined direction of rotor and driveshaft rotation;

a respective seal disposed about each cylindrical bore at the periphery of the rotor to seal around the cylindrical bore between the rotor and the stator;

a respective piston slidably disposed within each cylindrical bore;

a spark plug supported on the stator and operable to provide sparks within combustion chambers passing by the spark plug under rotation of the rotor in the predetermined direction, each combustion chamber formed at a respective one of the cylindrical bores by cooperation of the stator, the respective seal and the respective piston to enclose space between the respective piston and the stator along said cylindrical bore;

an air and fuel intake extending from an exterior of the stator to an interior thereof at a position circumferentially spaced about the central axis from the spark plug to feed fuel and air into the combustion chambers passing by the air and fuel intake under rotation of the rotor in the predetermined direction; and an exhaust outtake extending from the interior of the stator to the exterior thereof to discharge exhaust gases from each combustion chambers passing by the exhaust outtake after combustion under rotation of the rotor in the predetermined direction, the exhaust outtake being circumferentially spaced about the central axis from the air and fuel intake and spark plug;

whereby combustion of the fuel introduced to the combustion chamber of each cylindrical bore by the air and fuel intake due to ignition in said combustion chamber by the spark plug forces sliding of the respective piston to the inner end of said cylindrical bore to drive continued rotation of the rotor, under which said piston slides outwardly along said cylindrical bore under centrifugal force back toward the stator to compress the fuel and air in the combustion chamber for ignition of the fuel and air when said combustion chamber reaches the spark plug, the exhaust gases being discharged when said combustion chamber subsequently reaches the exhaust outtake before return of said combustion chamber to the air and fuel and intake under the continued rotation of the rotor.

The air and fuel intake may comprise a fuel injector communicable with a fuel source via a fuel pump.

Preferably there is provided a starter operable to initiate the rotation of the rotor.

There may be provided a breaker arm actuable to break contact points of the breaker arm by features carried for rotation with the rotor and spaced apart about the central axis by angular spacing corresponding to spacing of the angularly spaced positions of the cylindrical bores in the rotor about the driveshaft, the contact points of the breaker arm being wired between a battery and primary windings of an ignition coil and secondary windings of the ignition coil being wired to the spark plug.

Preferably opening and closing of the contact points of the breaker arm also control operation of the air and fuel intake.

There may be provided an air compressor coupled to the air and fuel intake to pressurize the air delivered thereto.

Preferably the air compressor is coupled to the driveshaft for driving of the air compressor by rotation of the driveshaft.

Preferably there is provided a compressed air storage tank coupled between the air compressor and the air and fuel intake to store pressurized air from the air compressor.

Preferably there is provided an air pressure regulator coupled to the air and fuel intake to regulate pressure of air communicated thereto.

Preferably there is provided a valve associated with the air and fuel intake to control passage of air therethrough.

Preferably there is provided a water separator on an air intake line that is coupled to the air and fuel intake to remove water droplets from air approaching the air and fuel intake through the air intake line.

Preferably each cylindrical bore is oriented at a forty-five degree angle to a respective radius of the rotor.

Preferably a face of each piston facing outward toward the stator curves about the central axis.

Preferably each cylindrical bore and the respective piston are arranged to maintain a predetermined rotational orientation of said piston about a longitudinal axis of said cylindrical bore during rotation of the rotor in the predetermined direction to situate the face of said piston in an orientation following an inner surface of the stator against which the seals engage.

The cylindrical bores and pistons may be circular in cross-section with one side of each piston having a greater weight than an opposing side of said piston so that said one side will trail said opposing side under rotation of the rotor in the predetermined direction. In this case, each piston may comprise a weight fixed to a body of the piston on said one side thereof. This weight preferably comprises a body of material of greater density than said piston received in a cavity within said piston. Preferably the body of material is a threaded insert and said cavity is a correspondingly threaded bore extending into said piston for threaded receipt of the insert therein.

The engine may include a fluid inlet passage extending from outside the stator into the rotor and communicable with each cylindrical bore through the inner end thereof via a fluid inlet port equipped with a one way inlet valve; a fluid outlet passage closed off from the fluid inlet passage, extending from outside the stator into the rotor and communicable with each cylindrical bore through the inner end thereof via a fluid outlet port equipped with a one way outlet valve; and a fluid outlet conduit coupled with the fluid outlet passage; whereby fluid is drawn into each cylindrical bore under movement of the respective piston toward the stator and forced out of said cylindrical bore to the fluid outlet conduit under subsequent movement of said respective piston toward the inner end of said cylindrical bore when the air and fuel in the combustion chamber of said cylindrical bore is ignited, thereby performing a fluid pumping compressing function for use of the engine as a pump or compressor. In this case, a fluid inlet conduit may be coupled with the fluid inlet passage and a pneumatic or hydraulic apparatus is coupled between the fluid inlet and outlet conduits for driven operation of the apparatus under operation of the internal combustion engine.

According to a second aspect of the invention there is provided a pump or compressor comprising:

a stationary stator defining a cylindrical interior of circular cross section;

a cylindrical rotor of circular cross section supported within the stator for rotation about a central axis, the rotor having a plurality of cylindrical bores extending thereinto from a periphery thereof at angularly spaced positions about the central axis, the cylindrical bores being oriented and positioned with respect to radii of the rotor to dispose an inner end of each bore forward of an outer end thereof in the predetermined direction of rotor rotation;

a respective seal disposed about each cylindrical bore at the periphery of the rotor to seal around the cylindrical bore between the rotor and the stator;

a respective piston slidably disposed within each cylindrical bore and sealed against the rotor around a full periphery of said cylindrical bore;

a spark plug supported on the stator and operable to provide sparks within combustion chambers passing by the spark plug under rotation of the rotor in the predetermined direction, each combustion chamber formed at a respective one of the cylindrical bores by cooperation of the stator, the respective seal and the respective piston to enclose space between the respective piston and the stator along said combustion chamber;

an air and fuel intake extending from an exterior of the stator to an interior thereof at a position circumferentially spaced about the central axis from the spark plug to feed fuel and air into the combustion chambers passing by the air and fuel intake under rotation of the rotor in the predetermined direction;

an exhaust outtake extending from the interior of the stator to the exterior thereof to discharge exhaust gases from each combustion chambers passing by the exhaust outtake after combustion under rotation of the rotor in the predetermined direction, the exhaust outtake being circumferentially spaced about the central axis from the air and fuel intake and spark plug;

a fluid inlet passage extending from outside the stator into the rotor and communicable with each cylindrical bore through the inner end thereof via a fluid inlet port equipped with a one way inlet valve;

a fluid outlet passage closed off from the fluid inlet passage, extending from outside the stator into the rotor and communicable with each cylindrical bore through the inner end thereof via a fluid outlet port equipped with a one way outlet valve; and a fluid outlet conduit coupled with the fluid outlet passage;

whereby combustion of the fuel introduced to the combustion chamber of each cylindrical bore by the air and fuel intake due to ignition in said combustion chamber by the spark plug forces sliding of the respective piston toward the inner end of said cylindrical bore to drive continued rotation of the rotor and force fluid out of said cylindrical bore to the fluid outlet conduit, said piston then sliding outwardly under centrifugal force toward the stator along said cylindrical bore under said continued rotation of the rotor to draw fluid into said cylindrical bore and compress the fuel and air in the combustion chamber for ignition of the fuel and air when said combustion chamber reaches the spark plug, and exhaust gases being discharged when said combustion chamber subsequently reaches the exhaust outtake before return of said combustion chamber to the air and fuel and intake under the rotation of the rotor.

Preferably lengths of shaft project from the rotor to outside the stator on opposite sides thereof and the fluid passages pass axially through said lengths of shaft into the rotor.

There may be provided bearings on opposite sides of the stator which support the lengths of shaft for rotation, with the lengths of shaft fixed to the rotor for rotation therewith.

According to a third aspect of the invention there is provided an engine comprising:

a stationary stator defining a cylindrical interior of circular cross section;

a cylindrical rotor of circular cross section supported within the stator interior for rotation with a drive shaft projecting from the stator along a central axis, the rotor having a plurality of cylindrical bores extending thereinto from a periphery thereof at angularly spaced positions about the driveshaft, the cylindrical bores being oriented and positioned with respect to radii of the rotor to dispose an inner end of each bore forward of an outer end thereof in the predetermined direction of rotor and driveshaft rotation;

a respective seal disposed about each cylindrical bore at the periphery of the rotor to seal around the cylindrical bore between the rotor and the stator;

a respective piston disposed within each cylindrical bore and freely slidable therealong;

a combustion system connected to the stator and operable to combust an oxygen and fuel mixture to exert a force from combustion of said oxygen and fuel mixture against the respective pistons in the cylindrical bores passing by the combustion system under rotation of the rotor in the predetermined direction; and an exhaust outtake extending from the interior of the stator to the exterior thereof to discharge exhaust gases from each cylindrical bore passing by the exhaust outtake under rotation of the rotor in the predetermined direction after the exertion of the force from the combustion against the respective piston in said cylindrical bore, the exhaust outtake being circumferentially spaced about the central axis from the combustion system.

The combustion system may comprise a pulse detonation combustor having an outlet thereof opening into the interior of the stator to direct a shockwave into each cylindrical bore during passage thereof past the outlet of the combustor.

Preferably an axis of the outlet of the combustor extends into the interior of the stator at an oblique angle relative to a radius of the interior of the stator at the location of the outlet around the central axis and relative to a longitudinal axis of each cylindrical bore when said bore is situated at the location of the outlet around the central axis, the axis of the outlet sloping toward the predetermined direction of the rotor and driveshaft rotation relative to the central and longitudinal axes as the axis extends into the interior of the stator.

According to a fourth aspect of the invention there is provided a pump or compressor comprising:

a stationary stator defining a cylindrical interior of circular cross section;

a cylindrical rotor of circular cross section supported within the stator interior for rotation with a drive shaft projecting from the stator along a central axis, the rotor having a plurality of cylindrical bores extending thereinto from a periphery thereof at angularly spaced positions about the driveshaft, the cylindrical bores being oriented and positioned with respect to radii of the rotor to dispose an inner end of each bore forward of an outer end thereof in the predetermined direction of rotor and driveshaft rotation;

a respective seal disposed about each cylindrical bore at the periphery of the rotor to seal around the cylindrical bore between the rotor and the stator;

a respective piston disposed within each cylindrical bore and freely slidable therealong;

a combustion system connected to the stator and operable to combust an oxygen and fuel mixture to exert a force from combustion of said oxygen and fuel mixture against the respective pistons in the cylindrical bores passing by the combustion system under rotation of the rotor in the predetermined direction; and an exhaust outtake extending from the interior of the stator to the exterior thereof to discharge exhaust gases from each cylindrical bore passing by the exhaust outtake under rotation of the rotor in the predetermined direction after the exertion of the force from the combustion against the respective piston in said cylindrical bore, the exhaust outtake being circumferentially spaced about the central axis from the combustion system;

a fluid inlet passage extending from outside the stator into the rotor through a first face thereof and communicable with each cylindrical bore through the inner end thereof via a fluid inlet port equipped with a one way inlet valve;

a fluid outlet passage closed off from the fluid inlet passage, extending from outside the stator into the rotor through a second face thereof opposite the first face and communicable with each cylindrical bore through the inner end thereof via a fluid outlet port equipped with a one way outlet valve; and a fluid outlet conduit coupled with the fluid outlet passage;

whereby the force exerted on the respective piston in each cylindrical bore forces sliding of the respective piston toward the inner end of said cylindrical bore to drive continued rotation of the rotor and force fluid out of said cylindrical bore to the fluid outlet conduit, after which exhaust gases from the combustion are discharged when said combustion chamber reaches the exhaust outtake before return of said cylindrical bore to the combustion system under the rotation of the rotor and said piston slides outwardly under centrifugal force toward the stator along said cylindrical bore under said rotation of the rotor to draw fluid into said cylindrical bore.

The pump or compressor may be provided in combination with:

an electrical generator having a rotatable input shaft for production of electricity by the electrical generator under rotation of the input shaft about a rotational axis thereof;

a turbine coupled to the input shaft of the electrical generator and comprising a series of vanes arranged circumferentially around a turbine axis about which the turbine is rotatable; and a nozzle fed from the fluid outlet conduit of the pump or compressor and having an outlet oriented in a direction acting on the vanes of the turbine to drive rotation of the turbine and the input shaft of the electrical generator.

Preferably the nozzle comprises a slit in a tubular member coupled to and fed by the fluid outlet conduit.

Preferably the tubular member comprises an open end coupled to the fluid outlet conduit in fluid communication therewith and a closed end opposite the open end.

Preferably the turbine comprises vane pockets respectively defined between pairs of adjacent vanes, each vane pocket having an open end located between radially outer ends of the pair of adjacent vanes and an opposing closed end nearer the turbine axis.

According to a fifth aspect of the invention there is provided a pneumatically driven electrical generator comprising:

a source of compressed air;

an electrical generator having a rotatable input shaft for production of electricity by the electrical generator under rotation of the input shaft about a rotational axis thereof;

a turbine coupled to the input shaft of the electrical generator and comprising a series of vanes arranged circumferentially around a turbine axis about which the turbine is rotatable; and a tubular member comprising an open end coupled to the source of compressed air for receipt of compressed air flow therefrom and a closed end opposite the open end, and a slit in the tubular member between the open and closed ends on a side of the tubular member facing a periphery of the turbine to form a nozzle oriented in a direction acting on the vanes of the turbine to drive rotation of the turbine and the input shaft of the electrical generator.

BRIEF DESCRIPTION OF THE DRAWINGS

In the accompanying drawings, which illustrate exemplary embodiments of the present invention.

DETAILED DESCRIPTION

Figure 1:
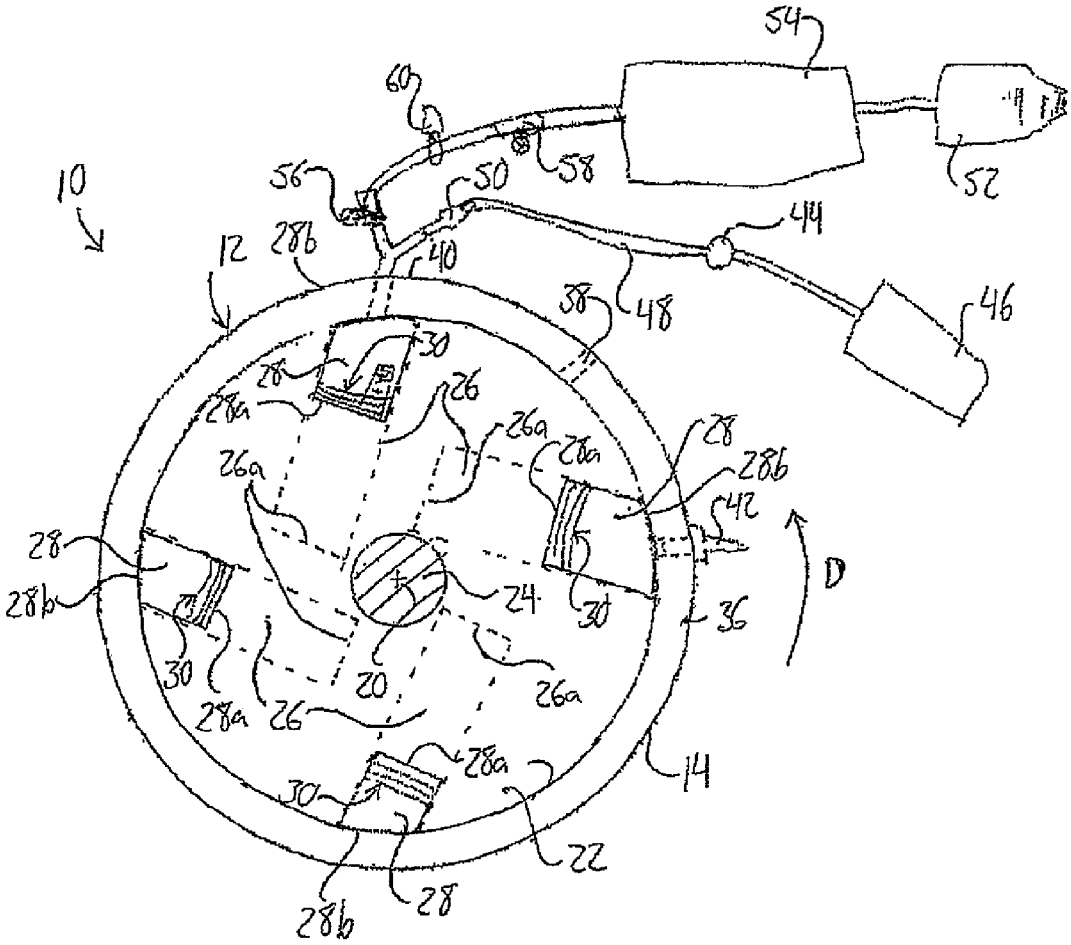
FIG. 1 is a schematic front end view illustration of a first embodiment internal combustion engine according to the present invention.

FIG. 1 schematically shows an internal combustion engine 10 according a first embodiment of the present invention. The engine features a stator or housing 12 in the form of a cylindrical outer peripheral wall 14 closed off at opposite ends of its cylindrical shape by circular front and rear end walls 16, 18, one of which has been removed in FIG. 1 to illustrate contents of the stator's interior and the other of which is not visible in that particular figure. The peripheral wall 14 of the stator closing concentrically about a central axis 20 forms boundaries of the stator's cylindrical interior space of circular cross section. Within the interior space of the stator 12, the engine 10 features a rotor 22 in the shape of a short cylinder of circular cross section concentric with the cylindrical peripheral wall 14 of the stator 12. The rotor 22 has a diameter slightly less than the inner diameter of the peripheral stator wall 14 and is fixed on a rotatable shaft 24 extending concentrically along the central axis 20 so as to be rotatable with the shaft inside the stator interior.

Four cylindrical bores 26 extend into the rotor 22 at the periphery thereof adjacent the inner surface of the stator periphery wall 14 at equally spaced apart positions ninety degrees from one another about the cylindrical periphery of the rotor. Each cylindrical bore 26 has its longitudinal axis oriented at forty-five degrees to a radius of the rotor at the respective angular position about the central axis 20. This oblique angling of the cylindrical bores relative to respective radii of the rotor is in the same direction for each bore, such that an inner end 26*a* of each bore 26 nearest the shaft 24 and furthest from the rotor periphery leads the outer end of the same bore 26 at the rotor periphery in a direction D in which the rotor 22 and driveshaft 24 are to rotate about the central axis under operation of the engine. Each cylindrical bore 26 is fitted with a respective cylinder liner.

A seal closes around the longitudinal axis of each cylindrical bore at the outer end thereof and biases in sealed engagement against the inner surface of the stator periphery wall 14. Although not illustrated in detail, the seal may be provided in the form of a spring energized seal featuring a wave spring at the top or outer end of the cylinder sleeve that applies pressure to a seal that is contoured to match and mate its outer end flush with the inner surface of the stator periphery wall 14.

Within each cylinder defined by a respective cylindrical bore, or bore and cylinder liner combination, is a piston 28 having a circular cross section, a flat bottom or inner end face 28*a* and a contoured top or outer end face 28*b* curving arcuately about the central axis 20 at a radius generally equal to the inner radius of the stator periphery wall 14 so that this contoured outer face 28*b* matches the curve of the inner side of the stator periphery wall 14 to mate flush thereagainst when the piston is displaced to the outer end of the respective cylinder during operation of the engine. A set of three piston rings 30 proximate the bottom or inner end of each piston provide sealing of the piston around the periphery thereof to the cylinder liner.

Figure 2:
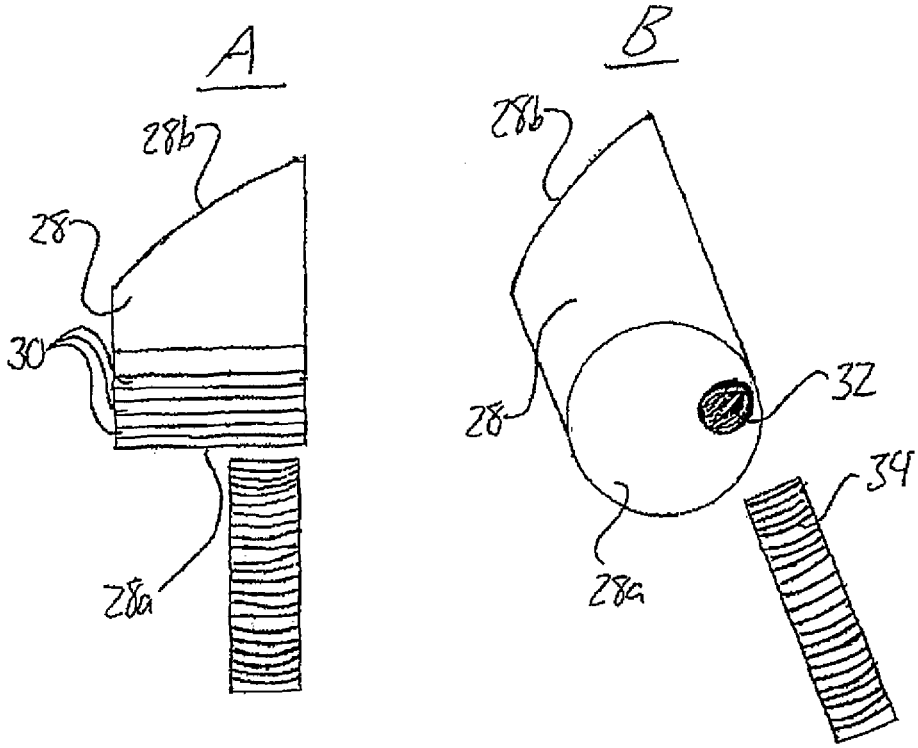
FIGS. 2A and 2B are schematic illustrations of a piston assembly of the internal combustion engine of FIG. 1, showing a piston body thereof in side elevational and end perspective views respectively.

As shown in FIG. 2, on a diameter of the piston 28 along which the outer face 28*b* curves, adjacent an end of this diameter at which the longest part of the piston, a threaded bore 32 extends into the piston 28 from the planar inner face 28*a* thereof parallel to the longitudinal axis of the piston. A correspondingly threaded stud or headless bolt 34 has a length equal to or less than the length of the threaded bore 32 and is threaded thereinto sufficiently far so as not to project past the flat inner end face 28*a* of the piston. The stud 34 is made of a material of greater density than the piston body so as to act to increase the weight of the longer side of the piston to a value greater than it would have been if the piston was left solid with no threaded bore or other cavity for receiving a weight-adding higher density insert like the illustrated stud. The stud forms a weight embedded within the piston body so that the resulting heavier side of the piston will tend to trail the shorter lighter side of the piston when the rotor is spun in direction D. This acts to maintain the piston in a predetermined orientation about the longitudinal axis of the respective cylinder during driven rotation of the rotor so that the contour of outer end face 28*b* of the piston is kept in the proper orientation to match the curve of the inner surface of the stator periphery wall 14.

A spark plug port 36, exhaust port 38 and intake port 40 each extend through the peripheral wall 14 of the stator from the inner to outer surface of the wall to fluidly communicate the interior space of the stator 12 with the surrounding external environment.

A spark plug 42 seated on the peripheral wall 14 of the stator seals against the outer surface thereof around the spark plug port 36 to project inwardly along the spark plug port in the peripheral wall 14 toward the stator interior. The exhaust port 38 is left open to allow discharge of exhaust gases from the interior space of the stator 12.

The intake port 40 is in sealed fluid communication with fuel and air delivery systems in order to introduce a mixture of fuel and air into the interior of the stator 12. A fuel pump 44 is operable in a known manner to draw fuel inside a fuel tank 46 and pump it onward from this fuel source through a fuel line 48 to a fuel injector 50 proximate the intake port 40. In a conventional manner, the fuel injector 50 is operable to atomize the pressurized fuel from the fuel pump to spray a dose of fuel into a stream of delivered to the intake port 40. In the first embodiment, a rotary compressor 52 is driven to compress ambient air drawn thereinto and pump this air into a compressed air storage tank 54. A solenoid valve 56 is controlled to open and close an air intake line connecting the storage tank 54 to the intake port to control intake of air into the stator 12 through the intake port. An air pressure regulator 58 and a water separator 60 are installed on the air intake line between solenoid valve 56 and the storage tank 54 to regulate the pressure of the intake air and separate water droplets therefrom.

In the first embodiment, the intake port 40 and the spark plug port 36 are spaced ninety degrees apart about the central axis 20, with the exhaust port 38 centered between them at forty-five degrees from each about the central axis 20. The opening of the solenoid valve 36 and the actuation of the fuel injector 50 are timed to inject the fuel and air mixture through the intake port 40 as each cylinder passes thereby during rotation of the rotor 22. At each cylinder, a combustion chamber is enclosed in the space bound by the cylinder liner and the seal between the outer face 28*b* of the respective piston and the peripheral wall of the stator.

As the cylinder passes by the intake port 40 when the rotor is spinning, the mixture of compressed air and atomized fuel enters this combustion chamber. When the rotor rotates within the stator (housing), centrifugal force moves the respective piston outward away from the inner end of the cylinder toward the peripheral wall 14 of the stator 12, which further compresses the air and fuel mixture in the combustion chamber as the rotor rotates the 270 degrees from the intake port 40 to the spark plug port 36. Having the air and fuel mixture in between the piston top or outer end and the stator's peripheral wall will act as a glide for the piston to move around the stator. As the cylinder reaches the spark plug, a spark provided thereby ignites the mixture and the resulting explosion exerts a force on the outer face of the piston, sending the piston linearly inward along the cylinder toward the inner end thereof nearest the center of rotation, where the flat inner face 28*a* of the piston impacts against the rotor 20. The force exerted on the inner end of the cylinder by this impact acts perpendicularly to a moment arm from the central axis, thereby forcing the rotor to continue turning in the same rotational direction D.

This movement of the piston to the bottom or inner end of the cylinder as a result of the ignition of the air/fuel mixture and resulting explosion occurs as the cylinder moves forty-five degrees from the spark plug port 36 to the exhaust port 38, where the exhaust gases from the explosion are allowed to escape the interior of the stator 12. The cylinder moves another forty-five degrees to arrive back at the intake port 40, where another air fuel mixture is introduced into the space between the stator peripheral wall and the piston, which has yet to move fully back outward to the outer end of the cylinder after being driven to the inner end by the combustion of the previous dose of air/fuel mixture in that cylinder. With four equally spaced cylinders and the ninety degree spacing of the spark plug and intake, the injection of air/fuel mixture into one cylinder occurs at substantially the same time as the ignition of a compressed air/fuel mixture in the next adjacent cylinder.

Figure 4:
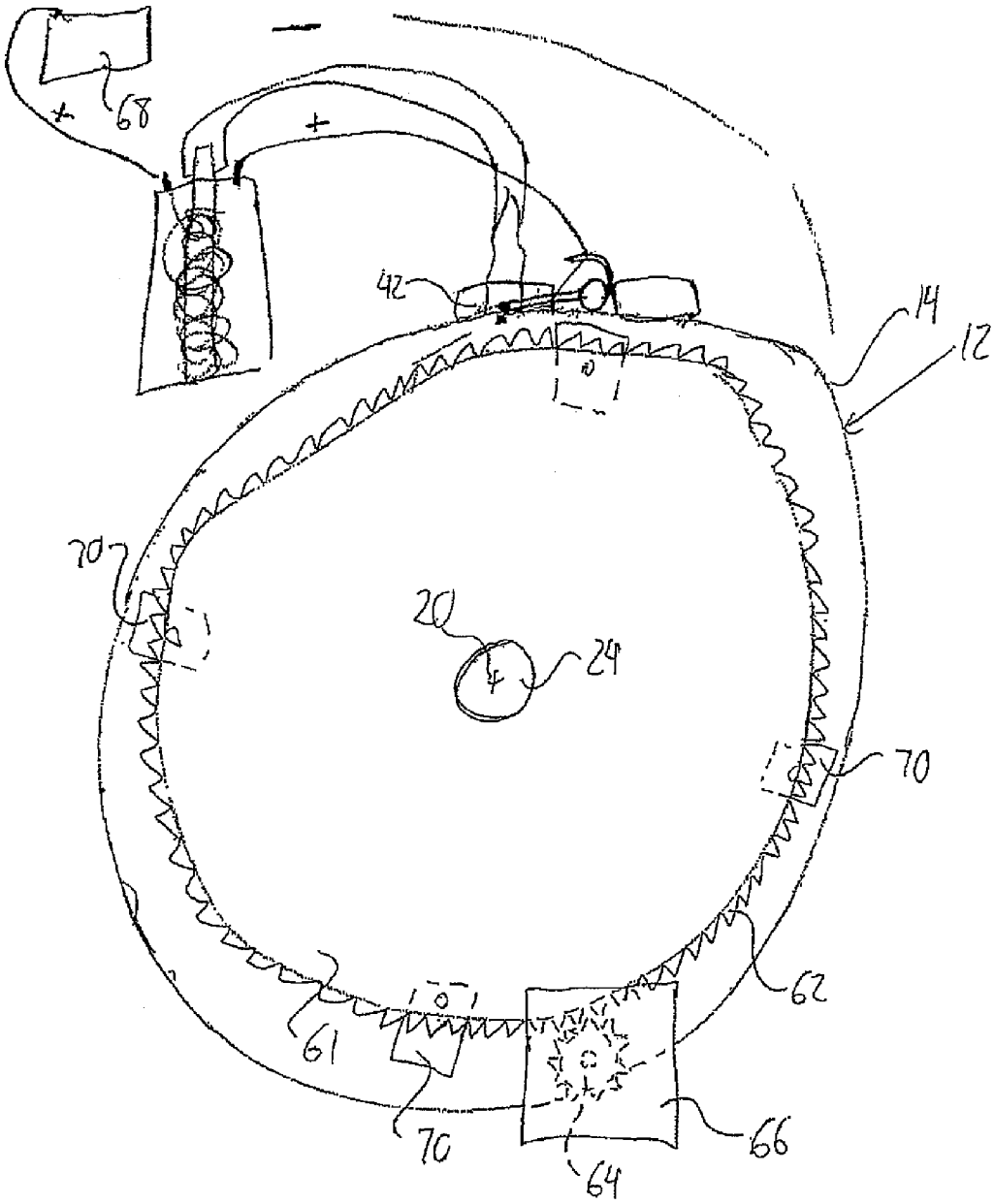
FIG. 4 is a schematic illustration of an ignition system of the internal combustion engine of FIG. 1.

FIG. 4 schematically illustrates starting and ignition systems of the engine 10. In a conventional manner, a flywheel 61 is fixed to the driveshaft 24 to smooth the rotational motion thereof and a starter ring gear 62 is fixed to the flywheel to present outwardly projecting gear teeth at the periphery thereof which are engaged by the teeth of a pinion gear 64 rotationally driven by an electric starter motor 66 powered by a battery 68 so that the initial rotation needed to start the engine 10 is provided by actuation of the starter motor 66 to drive rotation of the flywheel, the driveshaft fixed thereto and the rotor fixed on the driveshaft through driven rotation of the starter pinion 64. A breaker arm 68 is carried on the exterior of the stator at the periphery thereof. Four tabs 70 are fixed to the flywheel at positioned spaced ninety degrees apart around the central axis to correspond to the spacing of the cylinders around the rotor. Each tab 70 projects outward past the periphery of the ring gear equipped flywheel 61, which is positioned close enough to the stator 12 along the driveshaft 24 so that as each tab passes by the breaker arm and condenser on the stator, it forces apart the contact points of the breaker arm. In a known manner, the contact points of the breaker arm form a switch between the battery 68 and the primary windings of an ignition coil 72, so that separation of the points (opening of the switch) collapses the magnetic field of the primary windings and causes a high voltage pulse across the terminals of the secondary windings, which are wired to the spark plug so that this high voltage causes the plug to spark. The positions of the tabs around the central axis equal or nearly match those of the cylinders so that a spark is produced by each tab as a respective one of cylinders passes by the spark plug.

In the illustrated embodiments, where the spark plug and the intake are spaced apart by the same angle spacing apart adjacent cylinders, the fuel injector and solenoid valve of the air/fuel intake system are wired for actuation by the same separation of the breaker arm contact points that provides the ignition spark, as when one cylinder is passing the spark plug during rotation of the rotor 20, the leading adjacent cylinder is passing the intake.

Figure 3:
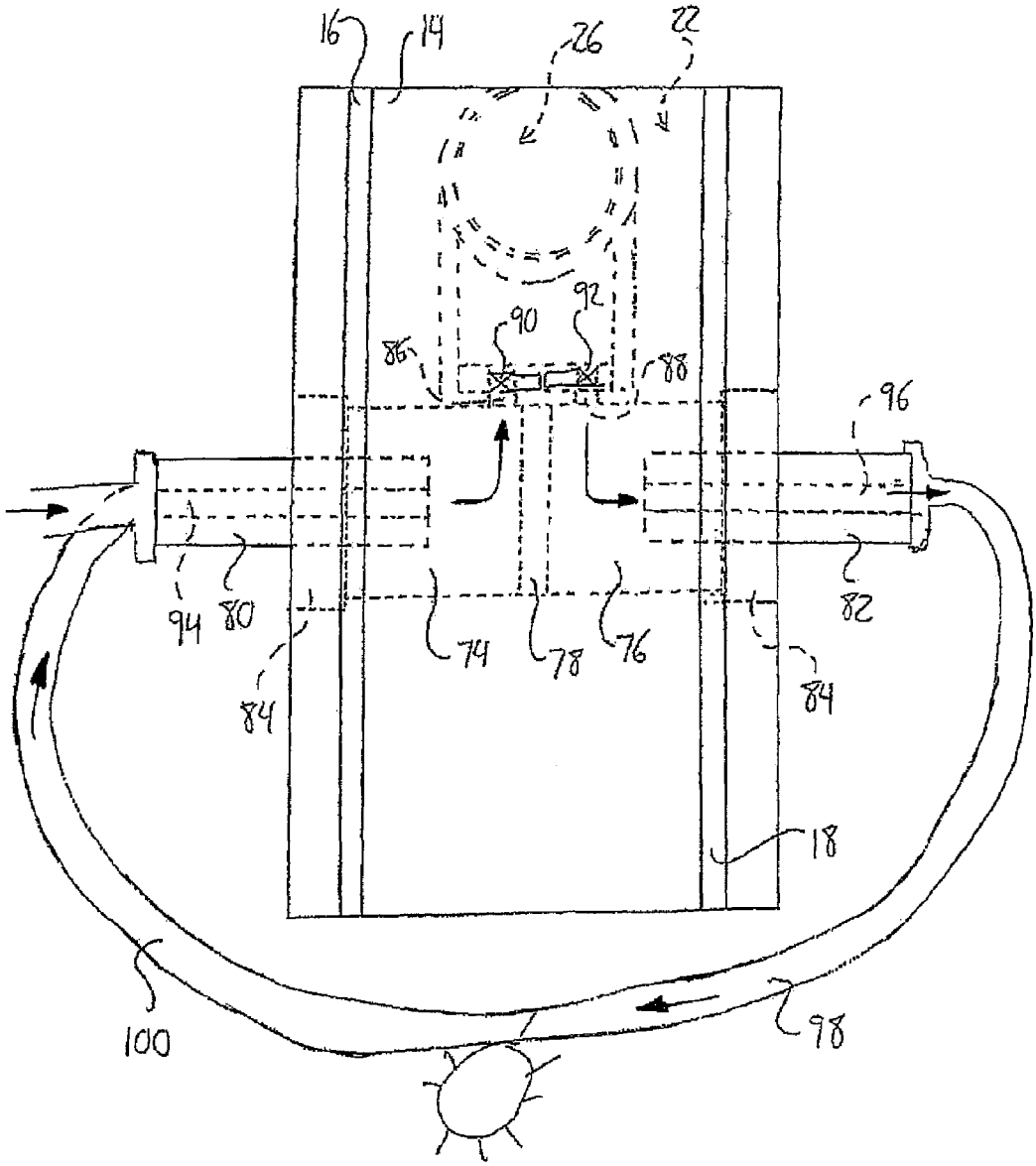
FIG. 3 is a schematic side view illustration of a second embodiment internal combustion engine according to the present invention, employing a pulse detonation combustor to drive rotation of the engine.

FIG. 3 shows a second embodiment of the engine that adds additional features to enable use of the engine to form a fluid pumping or compressing operation. In this embodiment, two hollow chambers 74, 76 are formed inside the rotor 22' along the central axis 20 on opposite sides of a central plane of the rotor 22' normal to the central axis 20. A central wall or barrier 78 at this central plane separates and closes off the equally dimensioned chambers 74, 76 from one another. Instead of a single continuous driveshaft passing through the rotor 22' at the central axis 20, two separate shafts 80, 82 are fixed to the rotor to project therefrom along the central axis 20 on opposite sides of the rotor. One shaft 80 extends through the front end wall or face 16 of the stator, and the other shaft 82 extends through the opposite rear end wall or face 18 of the stator. Bearings 84 rotatably support the two shafts 80, 82 on the outside of the stator end walls or faces, in the same way the driveshaft of the first embodiment may be rotatably supported. The first shaft 80 extends into the first chamber 74 adjacent the front end face 16 of the stator 12 and the second shaft 82 extends into the second chamber 76 adjacent the rear end face 16 of the stator 12.

Each cylinder in the rotor is connected to the first and second chambers 74, 76 by air inlet and outlet ports 86, 88, respectively, passing through the inner end 26*a* of cylindrical bore 26 on a opposite sides of the barrier 78 at the rotor's central plane. One way air inlet and outlet valves 90, 92 are seated at the air inlet and outlet ports 86, 88 respectively for opening and closing thereof to control flow of air into and out of the inner or bottom end of the cylinder on the side of the piston opposite where the combustion of the air/fuel mixture occurs during engine operation. An inlet bore 94 in the first shaft 80 extends therethrough along the central axis 20 from outside the stator into the first chamber 74 therein, just as an outlet bore 96 in the second shaft 82 extends therethrough along the central axis 20 from outside the stator into the second chamber 74 therein. The stator and rotor are sealed about the rotating shafts so that the inlet bore 94, first chamber 74 and inlet port 86 form an air inlet passage extending into the stator and rotor for selective fluid communication with each cylinder through the respective air inlet valve 86. The outlet bore 96, second chamber 76 and outlet port 88 form an air outlet passage extending into the stator and rotor for selective fluid communication with each cylinder through the respective air outlet valve 88.

During operation of the engine as described above, movement of each cylinder outward under the centrifugal force of the spinning rotor during the compression stage of the combustion cycle will reduce pressure behind the piston (i.e. between the piston and the inner end of the cylinder), which draws air into the cylinder behind the piston via the air inlet passage and one-way air inlet valve. Then during the combustion or power stage of the combustion cycle where the piston is driven back toward the inner end of the cylinder by the combustion of the air/fuel mixture, the air behind the piston is compressed and ultimately forced out of the cylinder through the one-way air outlet valve and air outlet passage. The engine thus acts as an air compressor. An air hose 98 may be coupled with the external end of the second shaft 96 outside the stator via known pneumatic couplings to provide an air outlet or discharge conduit for delivery of the pressurized air from the engine/compressor to pneumatically driven tools or equipment for driving thereof by operation of the engine. The engine/compressor may be used in an open or closed loop pneumatic system, drawing either ambient air from the surrounding environment or return air sent back to the engine/compressor from the pneumatic tools or equipment through an air inlet conduit provided by a return hose 100.

Although described above as compressing and moving air, it will be appreciated that the second embodiment engine can alternatively be used as a pump for conveying liquid instead of air or other gasses. The rotation of the shafts in the second embodiment may also be used for taking off rotational power directly from the engine, allowing use of the engine as a direct rotational drive source, a pneumatic or hydraulic compressor or pump, or a combination of the two. Where the engine is to be used only as a compressor or pump, and thus requiring no externally accessible driveshaft for direct rotational mechanical drive, the rotor may be rotatably carried by bearings on stationary shafts entirely internal to the engine (i.e. not projecting outward from the stator). In a further alternative, the two-shaft arrangement may be replaced by a single shaft embodiment where the single shaft passes through the barrier between the chambers in the rotor in a sealed manner and has two separate internal passages extending along the shaft from opposite ends and passing radially outward through the shaft periphery within the respective chambers.

The Applicant has proposed the following dimensions, materials and other specifications of one embodiment as examples only, and it will be appreciated that the dimensions and materials used may be altered without departure from the scope of the present invention. An aluminum rotor 9 cm wide and 15 cm in diameter may feature cylinders with 3 cm inside diameters, with aluminum pistons 2.9 cm in diameter and 4.5 cm long and copper seals with 3 cm inside diameters and 2.85 cm long. A 1.9 cm diameter stud 3 cm long may be used as the piston weight. The stator may have a 15.2 cm inside diameter and be made of metal. The air and fuel mixture is compressed into the cylinder with the intake air at 120 psi and the fuel injected at 90 psi. The inlet and outlet ports at the inner or bottom end of the cylinder may be 5 mm diameter and 1 cm deep parallel to the cylinder's longitudinal axis, then turn toward the central axis and continue with 5 mm diameter for 3 cm long towards the center. The center of the rotor can have a 3.6 cm diameter hole, 4 cm deep on each side (front, and back) to form the chambers, with 1 cm of aluminum left in the center of rotor to act as the separating barrier wall. The shafts on the bearings holding the rotor may have 5 mm diameter holes or bores allowing the fluid or air to move in and out of the shafts.

Applicant conceives that the igniting and injecting of fuel at the same time causing a faster rotation, with more pressure, and that when the motor is rotating at a comfortable speed, the fuel injector can be shut off, and the collection of used air in the air tank from the compressor, will keep the rotor rotating at the same rpm's. Able to pump gas or liquid fluids and provide direct rotational output, the second embodiment engine would be operable to run or turn multiple turbines, gen-heads, rotors, and other equipment. It will be appreciated that the number of cylinders in the rotor may be increased or decreased, and the angular spacing and oblique angling of the cylinders may also be varied without change to the principles under which the rotation of the rotor is driven.

Figure 5:
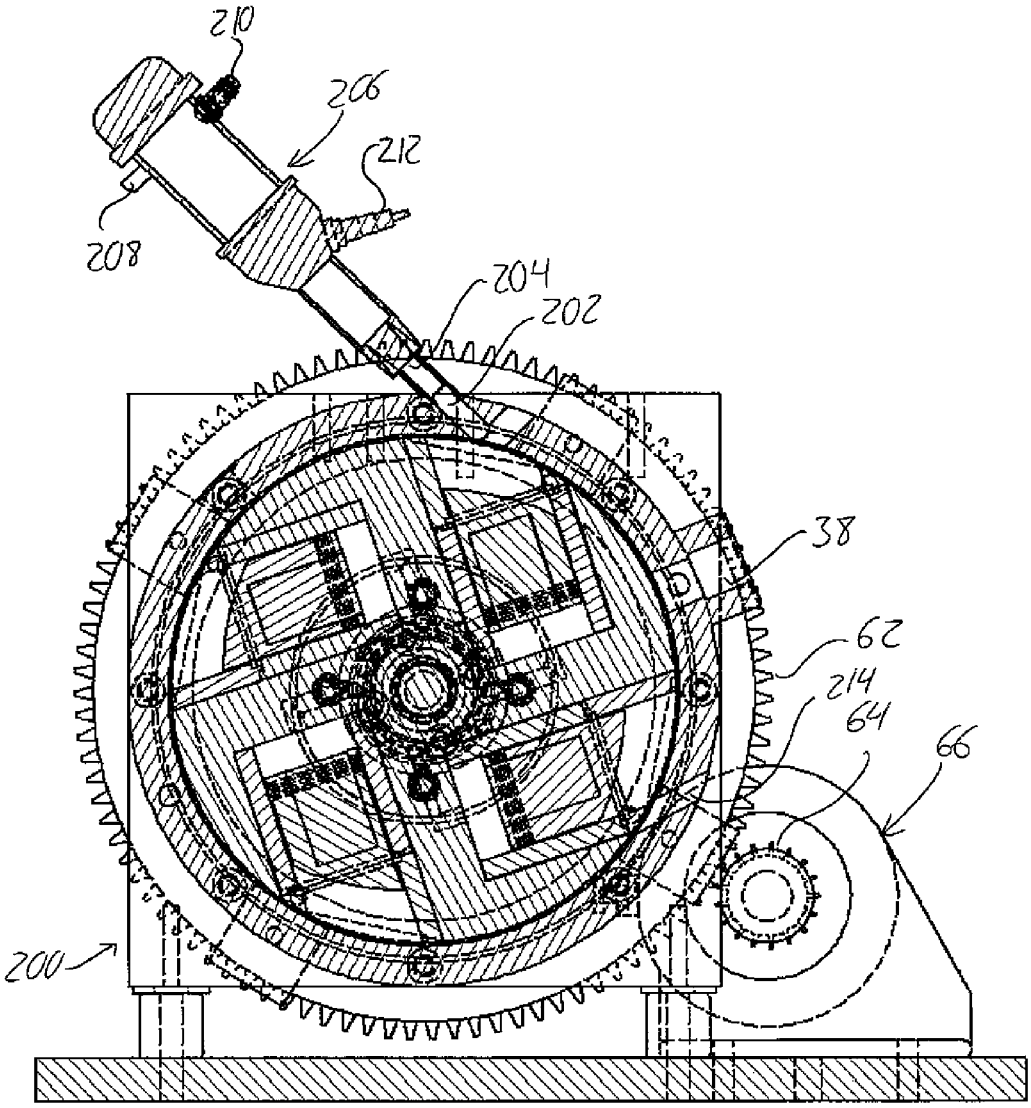
FIG. 5 is a schematic front end view illustration of a third embodiment engine with the stator and rotor thereof cut away for illustrative purposes.

FIG. 5 shows a third embodiment engine 200 of the present invention that features substantially the same configuration of free-sliding pistons disposed in cylindrical bores disposed in the rotor at oblique angles relative to the radii of the rotor where the bores extend into the rotor periphery. These pistons are again free to slide fully from the bottom inner end of their bores fully out to the periphery of the rotor, where the end faces of the pistons are shaped to conform to the cylindrical inner surface of the stator housing. The pistons are free sliding in that lack of any mechanical connection or link to the rotor other than the sliding interface between the piston periphery and the surrounding cylindrical wall in the respective bore in the rotor.

The third embodiment differs from the preceding embodiments in that the stator's intake port and separate spark plug port have been replaced with a single opening 202 through the cylindrical peripheral wall of the stator, which receives the outlet end 204 of a pulse detonation combustor 206 supported at the exterior of the stator. While only schematically illustrated in this embodiment, the pulse detonation combustor is configured in a known manner, coupled to an air inlet 208 and a source of fuel 210, for example propane, and uses an igniter 212, such as a spark plug, to ignite the mixture of air and fuel, but is configured to effect detonation of the mixture as opposed to just deflagrating the mixture. As a result, the combustor 206 emits a shockwave from the outlet of the combustor into each cylindrical bore as it passes by the position of the combustor outlet at the peripheral wall of the rotor.

The outlet of the combustor is oriented to tilt an axis thereof out of alignment with the radius of the cylindrical stator where the outlet opens to the stator interior so that the end of the combustor outlet leads the rest of the combustor in the rotor's direction of rotation around the central axis of the engine. That is, moving inward toward the interior space of the rotor through the outlet of the combustor and the opening in the stator periphery through which the combustor outlet communicates with the stator interior, the axis of the combustor obliquely intersects the stator radius at the opening 202 in the stator periphery and passes through the stator radius in the predetermined rotation direction of the rotor. The angular difference between the stator radius and the combustor outlet axis exceeds the angular difference between the longitudinal axis of each bore in the rotor and the respective radius of the rotor where the bore extends into the rotor from the periphery thereof. Accordingly, with the combustor outlet axis oriented obliquely relative to the bore axis when one of the cylindrical bores is positioned with the combustor opening 202 opening into it (as shown), for example with a difference of thirty between them, the shockwave emitted from the combustor into the cylindrical bore is directed toward a leading side of the bore in the predetermined direction of rotor rotation. As a result, the force of the shockwave is exerted against both the outer end face of the piston and this leading side of the cylinder wall.

This directionality of the output force from the pulse detonation combustion system is thus intended to better contribute to rotation of the rotor in the predetermined direction of rotation than the non-detonating combustion system of the first two embodiments. The third embodiment may employ valved openings or ports in the bottom of each cylinder to function in the manner described in the second embodiment so that the downstroke of each piston toward the inner/bottom end of the respective cylinder acts to compress air introduced into the bottom of the cylinder beneath the piston by one of the valves and then exhaust this compressed air through the other one-way valve. The outlet conduit receiving the compressed air from the cylinders may be coupled to the pulse detonation combustor to provide the source of air required thereby for the combustion/detonation process.

Additionally or alternatively, compressed air from the cylinders may be directed back into the cylinders on the opposite side of the piston through a compressed air port 214 extending through the stator periphery at a location disposed ahead of the exhaust port relative to the combustor outlet in the rotor's rotational direction. Situated at a position past which each cylinder passes after the piston has been driven down and after the exhaust gases have been allowed to leave the cylinder, the compressed air inlet exerts another force against the outer face of the piston to further contribute to rotation of the rotor. As illustrated, this compressed air port may be angled relative to the bore axes to exert force against the leading side of the cylinder wall.

As also shown in the Figure, pure oxygen may also be fed into the combustor in addition to the air and fuel. In an alternate embodiment, the pure oxygen inlet may be used instead of, rather than in addition to, an air inlet 208.

Figure 6:
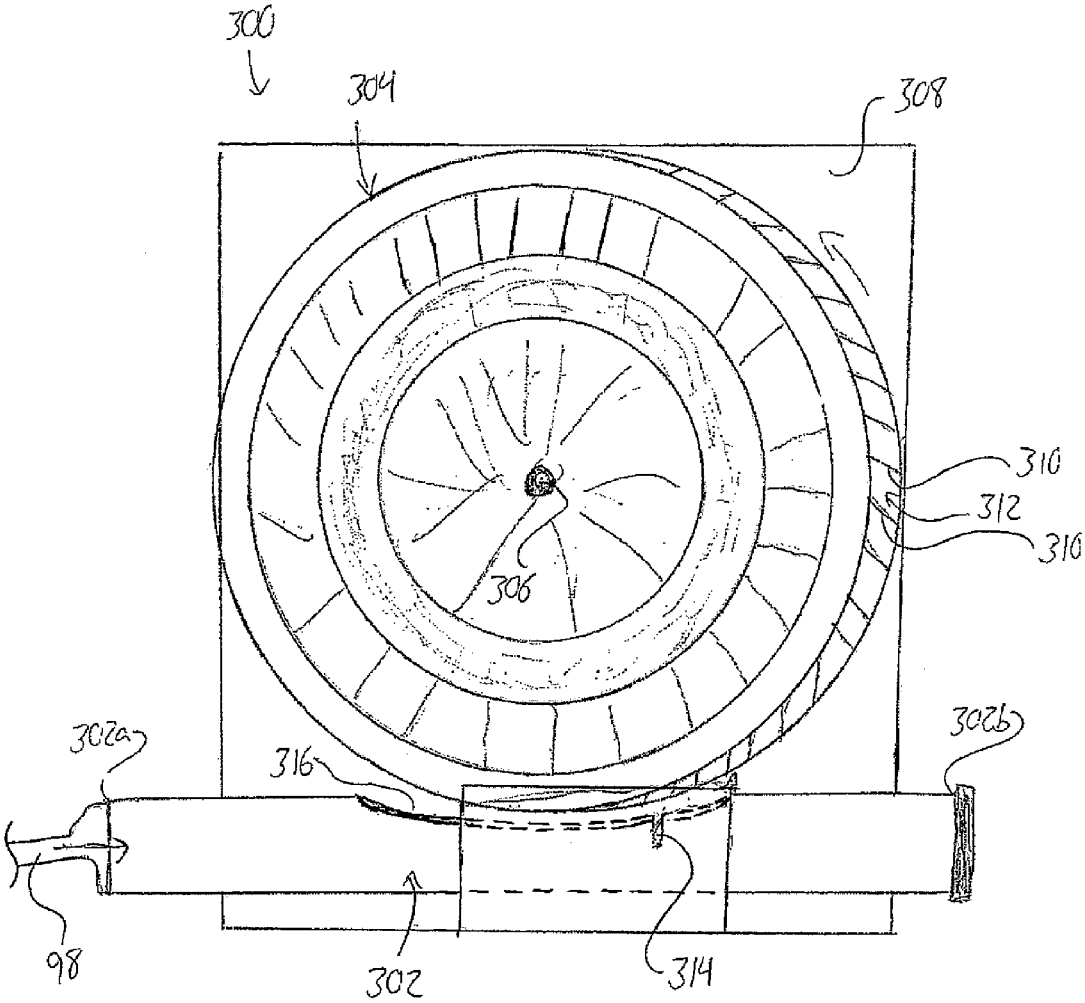
FIG. 6 is a schematic end elevational view of an electrical generator that is pneumatically driven by compressed air generated by the internal combustion engine of FIG. 3.

FIG. 6 schematically illustrates a pneumatically driven electrical generator 300 arranged for operation by a source of compressed air, for example by the compressed air generated by the second embodiment engine/compressor of FIG. 3. The outlet air hose 98 of the engine/compressor of FIG. 3 is coupled to an open end 302*a* of a tubular pipe 302 in sealed, fluid communication therewith to deliver compressed air from the engine/compressor into the interior of the pipe 302 through this open end. An opposing closed end 302*b* of the pipe 302 is capped off in a sealed manner to prevent the compressed air from passing through this end of the pipe 302.

Above the illustrated pipe 302, a turbine 304 is fixed on an input shaft 306 of a conventional electrical generator 308 so that rotation of the turbine 304 will drive rotation of the generator's input shaft 306 about the rotational axis shared by the shaft and turbine in order to generate electricity. The turbine 304 features vanes or blades 310 extending outwardly away from the shaft axis at circumferentially spaced positions therearound to the outer periphery of the turbine. In one embodiment, closed pockets 312 are defined repectively between pairs of adjacent vanes. Each such pocket has an open end defined at the periphery of the turbine between the radially outermost extents of the respective two adjacent vanes, but is closed off at an opposing inner end closer to the rotational axis of the turbine and shaft. In the illustrated embodiment, the vanes are backward-swept so as to curve in a direction opposite the direction of turbine rotation moving outward from the rotational axis, and each vane pocket is closed off at its opposing walls by annular end plates of the turbine in respective planes normal to the rotational axis.

The pipe 302 lies outside the periphery of the turbine to reside between the parallel vertical planes of the turbine's end plates and is positioned to pass in close proximity to the turbine's circular periphery, for example in a direction tangential thereto. In a side of the pipe 302 facing toward the turbine is a transverse slit 314 in the pipe wall that forms a nozzle directing the compressed air fed into the pipe 302 from the air hose 98 against the sides of the vanes facing opposite the turbine's direction of rotation. To accomplish this, the slit 314 lies in a radial plane of the pipe 302 at a position between the capped off closed end 302*b* and the point at which the pipe 302 is tangential to the radius of the turbine. To position the slit 314 close to the turbine, the pipe 302 has been coped, notched or cut on the side thereof facing the turbine, and then re-closed in a sealed manner at this cut-away portion, to form a curved recess or saddle 316 into which the turbine periphery extends. The slit 304 is positioned between the deepest part of the recess at the center of the recess's along the pipe axis (i.e. the point at which the pipe is tangential to the turbine radius) and the end of the recess nearest the closed end 302*b* of the pipe.

During operation of the engine/compressor, pressurized air is fed into the pipe 302, and discharged therefrom at the slit-type nozzle 314 to act against the vanes in a direction pushing against the trailing faces of the vanes inside the vane pockets to drive rotation of the turbine, in a counterclockwise direction in the illustrated embodiment. Fixed on the input shaft of the electrical generator 308, the turbine 304 thus rotates the input shaft 306 in the same direction, causing electricity to be produced by the generator in a conventional manner. Through use of this pneumatically driven generator coupled to the engine/compressor, direct mechanical energy can be captured from the engine's rotation for one purpose, with additional pneumatic energy from the engine/compressor then being simultaneously employed for the purpose of producing electrical energy.

Although the electrical generator is described as relying on the engine/compressor disclosed herein for a source of compressed air, it will be appreciate that a similar configuration of a pipe-fed turbine on an electrical generator may alternatively be fed compressed air or pressurized fluid from other sources.

Turning to FIGS. 7 to 12, a further embodiment of the present invention features an outer housing 400 having a hollow interior in which an engine/compressor 402, similar to that of FIG. 5, and pneumatically driven electrical generator 404, similar to that of FIG. 6, are installed and connected to one another for operation of the generator from the compressed air output of the engine/compressor.

Figure 8:
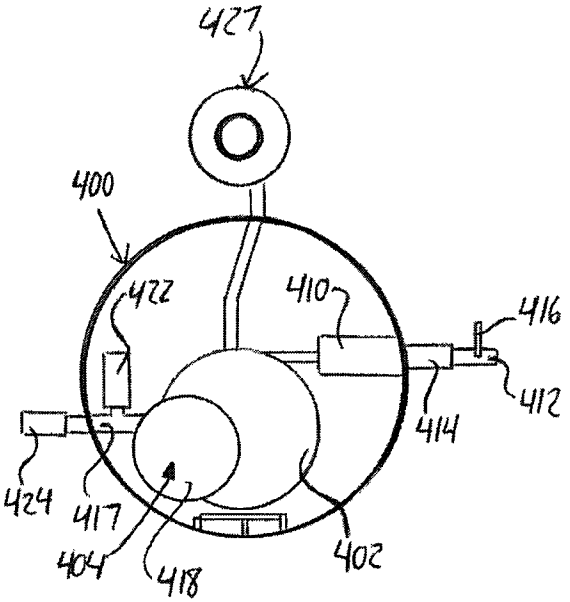
FIG. 8 is a straight-on elevational view of the apparatus of FIG. 7 from the same end thereof.
Figure 9:
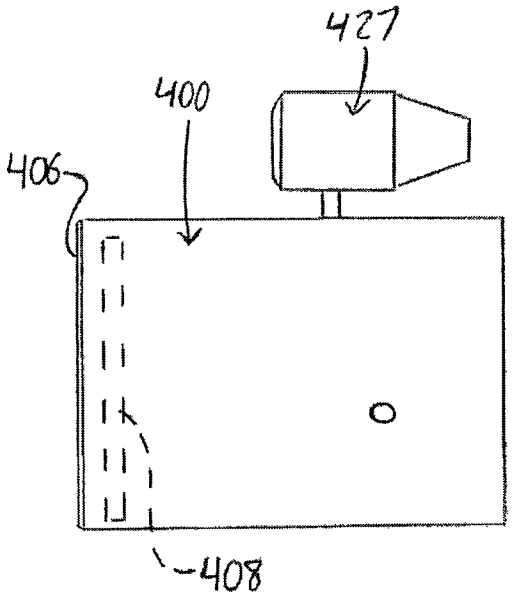
FIG. 9 is a side elevational view of the apparatus of FIGS. 7 and 8 illustrating installation of an air-filter equipped end cover thereon.
Figure 10:
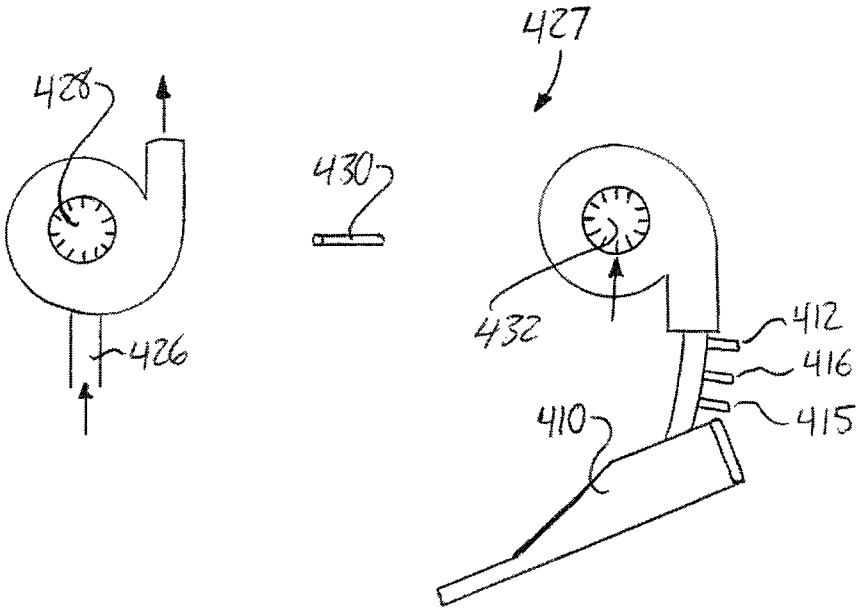
FIG. 10 is a schematic illustration of a device for harnessing energy from exhaust gases of the engine to feed fresh air to the combustion system thereof.

As shown in FIG. 9, an air filtration device 406 is mounted over an otherwise open end of the apparatus housing 400 to form an end-cover thereof and filter out particulate material and contaminants from air entering the housing through this otherwise open end to feed the air inlet passages that open into the bottom ends of the cylinder bores of the engine. A water separator, schematically shown at 408 in FIG. 8, may be mounted inside the apparatus housing 400 between the air filter 406 and the inlets of the air inlet passages to remove water droplets from the air before entering the bottom of the cylinder bores of the engine for subsequent compression of the air in the manner described above for other embodiments.

With reference to FIGS. 8 and 9, the pulse detonation combustor 410 of the engine 402 is mounted in the interior of the housing 400 to direct its outlet through the stator of the engine 402 to act on the pistons in the cylinders of the engine in the manner described above, and is fed by two lines extending through the peripheral wall of the housing 400, namely an air line 412 and a separate propane line 414. An oxygen supply inlet 416 is coupled to the air line at a location between the air line inlet and the exterior of the housing wall. Each line 412, 414 features a respective flashback arrestor 415 mounted at the exterior of the housing wall.

Tubular pipe 417 connects to the air outlet passage through which compressed air from the engine cylinders is discharged, and runs radially outward from the shaft axis of the engine 402 along the rear face of the stator between the stator and the electrical generation unit 418 of the pneumatically driven electrical generator 404. The pipe 417 is slit to form a nozzle at an intermediate location between the shaft of the engine and the outer periphery of the engine stator, and the turbine 420 of the generator 404 is disposed adjacent the nozzle of the pipe 417 in a position where the pressurized air exiting the pipe 417 through the slit drives rotation of the turbine 420. A portion of the compressed air from the engine/compressor 402 passes the slit in the pipe 417, continuing on to a carbon dioxide splitter 422 coupled to the pipe 417 inside the housing 400, where the carbon of the carbon dioxide in the compressed air is split from the oxygen and captured in the splitter, and the freed oxygen continues on to an outlet 424 disposed outside the housing 400, where an air hose can be connected via a coupler to capture the compressed air, including the oxygen from the splitter, for any of a variety of purposes. Carbon dioxide splitting apparatuses using membranes or porous substrates are disclosed in U.S. Patent Application Publication 2006/0213782 assigned to World Hydrogen, Inc. and U.S. Patent Application Publication 2007/0149392 assigned to General Electric Company, each of which is incorporated herein in its entirety. Where the carbon dioxide splitter requires it, for example as proposed in 2006/0213782, an electrical potential may be provided from the output of the electrical generation unit 418 of the pneumatically driven generator 404.

Referring to FIG. 9, an exhaust tube, pipe or muffler 426 fed is connected to the outlet end of the combustor at or adjacent where the combustor outlet opens into the cylinder bores moving therepast under rotation of the engine. Accordingly, the exhaust tube receives exhaust gases from the combustion that occurs as each cylinder bore passes by. Energy from the exhaust gas and part of the force from the shockwave generated by the combustor may be harnessed, for example by an energy recovery 427 device which may be installed on the exhaust tube 426 and the air intake line 412 of the combustor to operate in a manner similar to a turbocharger to actively feed the air intake of the engine's combustion system using mechanical power harnessed from the exhaust gas stream from the engine. Referring to the schematic illustration of FIG. 10, the energy recovery device thus features a turbine 428 installed in a housing that is fed with exhaust gases by the exhaust tube 426 to drive rotation of the turbine, which is fixed on a connecting shaft 430 on which an impeller 432 is also fixed so that rotation of the turbine drives rotation of the impeller 432 in a respective housing whose outlet feeds into the air inlet line 412 of the combustor 410.

Figure 7B:
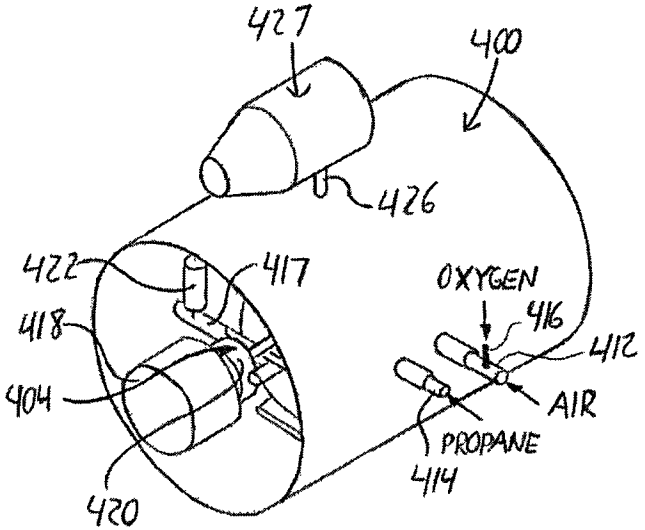
FIGS. 7A and 7B is are end perspective views of an apparatus of a further embodiment featuring an engine similar to that of the second embodiment driving the electrical generator of the third embodiment, an end cover of a housing of the apparatus being removed to show an interior thereof.
Figure 7A:
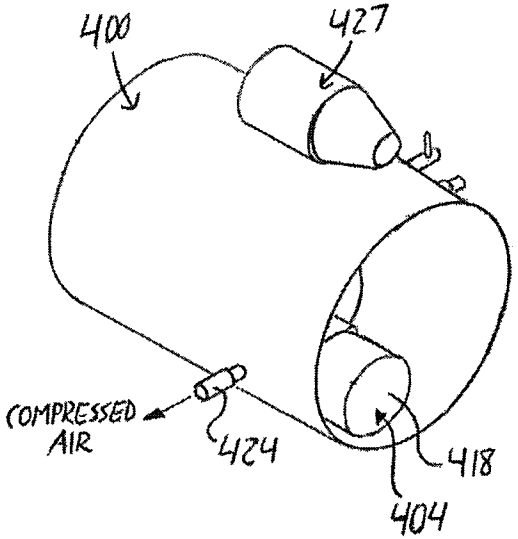
Figure 11A:
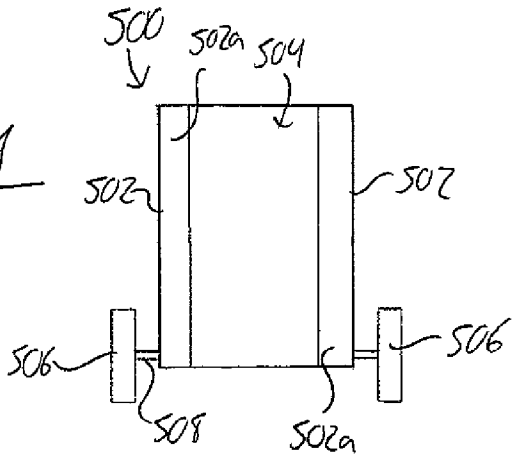
FIGS. 11A, 11B and 11C are top, end and side views of a wheeled frame for the apparatus of FIG. 7.
Figure 11B:
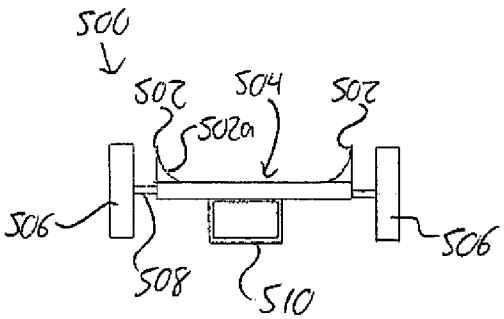
Figure 11C:
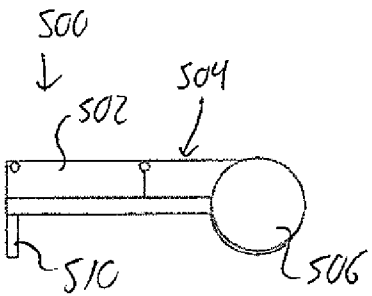

FIG. 11 shows a wheeled frame 500 on which the apparatus of FIGS. 7 to 9 may be mounted for improved portability to allow use of the same unit at various locations. The housing 400 of the apparatus fits between upstanding sides 502 of a cradle shaped base 504 of the frame, and a pair of wheels 506 are rotatably mounted at opposite ends of an axle 508 lying cross-wise of the frame to reach outwardly past the upright sides 502. A handle 510 is mounted to the frame at the end thereof opposite the wheeled axle 508. The illustrated handle depends downward from the frame when the frame is horizontally oriented, and projects from the frame to a horizontal tangential plane of the wheels so as to cooperate with the wheels to hold the frame in a level orientation parallel to the ground. To transport the apparatus, the handle is lifted from off the ground and used to pull or push the frame along the ground in an oblique orientation relative thereto.

Figure 12A:
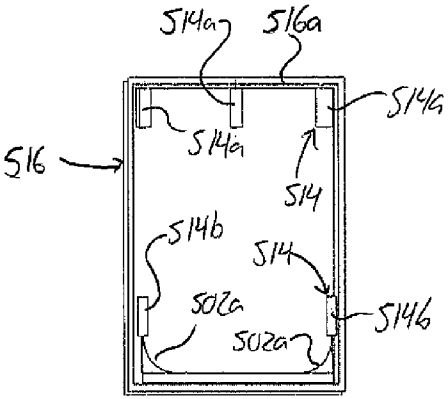
FIGS. 12A, 12B and 12C are end, side and bottom views of a spring-equipped frame for the apparatus of FIG. 7.
Figure 12C:
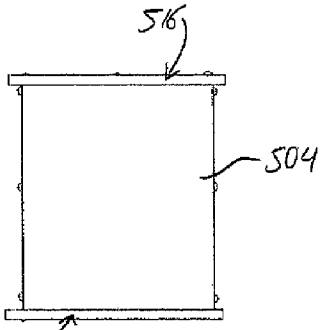
Figure 12B:
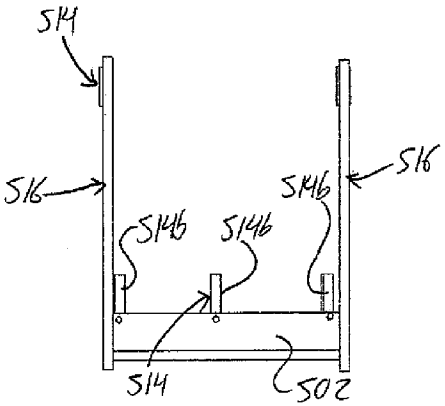

FIG. 12 shows another frame 512 that features springs 514 that carry the apparatus on a rigid framework in a position between upper springs 514*a* and lower springs 514*b* attached to top end bottom ends of the apparatus. The frame features the same cradle shaped base 504 as FIG. 11, with upstanding walls that are concavely curved at their inner, facing together sides 502*a*. At each end of the base, an open rectangular framework 516 stands perpendicularly upward form the frame across the respective end thereof, carrying a series of upper springs 516*a* that are suspended from the upper cross-bar 514*a* of the open rectangular framework. The lower springs are spaced apart along the upper edges of the upright side walls 502 of the cradle shaped base 504. The ends of the springs opposite those which are secured to the frame are connected to the housing of the apparatus to provide vibration isolation between the apparatus and the frame.

In the embodiment of FIGS. 7 to 12, air is being absorbed through the air filter system under the air-drawing action caused by the suction from the piston moving out (centrifugal force) in rotation of the Engine, and so air enters the front of the apparatus through the air filter, cleaning out dust or other contaminants. After the filter system there may be a water separator that separates the water from the air to reduce condensation in the. The air enters the Engine, being sucked up into the bottom of the cylinder by the outward movement of the piston away from the cylinder bottom. With the use of the air outlet valve in the bottom of Cylinders and the shock wave from the pulse combustor, the piston is forced down toward the bottom of the cylinder. The remaining force from the shockwave is directed to an exhaust gas turbine, which can be used to power an impeller that feeds fresh to the air inlet of the combustor. The air in the bottom of the cylinder (i.e. on the side thereof opposite that at which the combustion occurs) is compressed out the air outlet valve of the cylinder bore as the piston moves down or towards the center of the rotor. The air exits out the back end of the Engine where an air Turbine is attached to a Generator Head to create electricity using part of the airflow exiting the engine. As the remaining air passing by the turbine driving nozzle continues down the air passage, the air enters into a tube containing a membrane arranged to attract, capture and hold carbon from the carbon dioxide in the air, releasing pure oxygen from an outlet of the splitter, which may be used as an oxygen source for the combustor. The carbon dioxide splitter may use electrical output from the generator as input if the carbon dioxide splitting process requires an electrical potential. As the apparatus generates electricity and compressed air, part or all of the output air from the apparatus may be redirected as input to that apparatus, or as input feeding one or more further generator/compressor combinations to produce additional electricity. A base or frame holds the apparatus, and may include springs on the top and the bottom to absorb shocks or bounces, for example to prevent damage to components of the apparatus in earthquake prone areas, and/or features wheels attached to the base or frame for easy transfer to different areas.

Turning to FIG. 13, a unique pulse detonation combustor 600 of the present invention features a combustion cylinder 602 equipped at one end with a perforated end plate 604, and equipped at the opposite end with a tapered neck 606 that reduces down to a detonation tube 608 of smaller inner and outer diameter than the combustion cylinder 602. The end with the perforated end plate 604 is also equipped with a flashback arrestor 610, which is made up of a slide rod or plunger 612 lying axially on the longitudinal axis of the cylinder 602 and passing through a central hole in the perforated end plate to place the two ends of the plunger respectively inside and outside the cylinder, a cross-bar 614 fixed to the plunger to lie perpendicular thereto at the end of the plunger end outside the cylinder 602, and a circular cover plate 616 fixed to the plunger 612 at the end thereof inside the cylinder in a plane normal to the plunger. The perforated end plate 604 features a series of openings 606 passing through it at spaced apart locations around the plunger.

Near the end of the cylinder 602 opposite the perforated end plate 604, a butterfly valve assembly 618 features a butterfly valve plate 620 disposed inside the cylinder 602 for pivoting therein on a diametrical support shaft 622 fixed to the circular valve plate to project through diametrically opposite holes in the cylinder 602 to the exterior thereof. At opposite ends of this support shaft 622, a pair of parallel legs 624 project radially from the shaft in a common direction. At the distal end of each leg 624, a pin or stub 626 lies parallel to the support shaft 622 and projects from the leg 624 on the side thereof opposite the support shaft 622. The two pins 626 are coaxial with one another.

Outside the cylinder 602, each pin 626 is connected to a respective end of the cross-bar 614 of the flashback arrestor by a respective connecting rod 628. Each pin 626 is pivotally joined to the respective connecting rod 628 to allow relative pivoting therebetween about the pin axis, and each connecting rod 628 is likewise pivotally coupled to the cross bar 614 of the flashback arrestor to allow relative rotation between the connecting rod and cross bar about the axis of the cross bar. Accordingly, movement of the flashback arrestor in the axial direction of the cylinder causes the legs of the butterfly valve assembly 18 to pivot about their axes, thereby swiveling the butterfly valve plate inside the cylinder.

A spark plug 630 is mounted in a radial port in the cylinder wall at a position near the butterfly valve on the same side thereof as the cover plate of the flashback arrestor. The sparkplug is near enough to the butterfly valve so as to always reside between the butterfly valve and the cover plate of the flashback arrestor through the full stroke length of the flashback arrestor's axial movement in the cylinder.

Figure 13B:
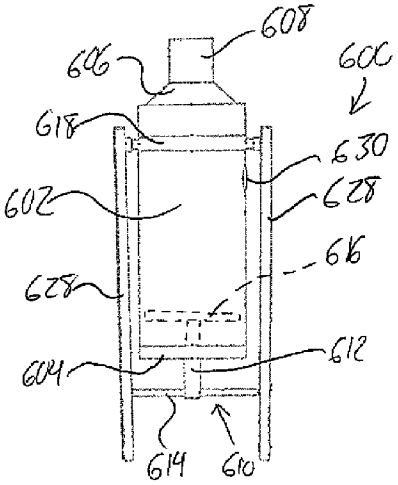
FIGS. 13A, 13B and 13C are side, top and end views of a combustor design that may be used to drive an engine of the present invention.
Figure 13A:
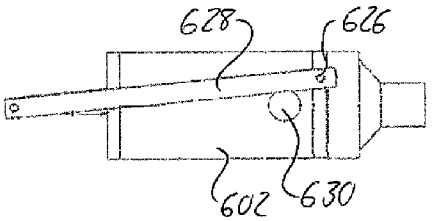
Figure 13D:
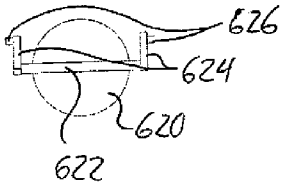
FIG. 13D illustrates a butterfly valve of the combustor design shown in FIGS. 13A, 13B and 13C.
Figure 13C:
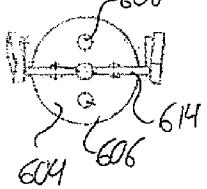

The openings in the perforated end plate are hooked up to the air and propane lines feeding into the cylinder. The length of the plunger is notably less than the axial length of the cylinder, and the cover plate 616 of the flashback arrestor is large enough to cover all the openings in the perforated end plate 604 when in a closed position abutted up against the end plate, but is smaller than the inner diameter of the cylinder so as to allow air and propane from the openings in the perforated end plate to flow past the cover plate when the cover plate 616 is situated in an open position at a distance from the end plate, as shown in FIG. 13B. to initiate a combustion cycle, air and propane are delivered to the openings in the end plate, which pushes the cover plate further into the cylinder from the closed position off the inner face of the end plate an into the open position spaced from the end plate, whereby the air and propane fill the interior of the cylinder.

As a cylinder of the engine rotor approaches or reaches the position around the stator at which the outlet of the detonation tube of the combustor resides, the spark plug is fired, causing the air and propane to ignite. The expansion of the ignited mixture forces the cover plate 616 of the flashback arrestor back against the end plate of the cylinder, thereby closing off the openings in the end plate to prevent flashback of the ignited mixture through these openings. The shockwave from the detonation is directed into the cylinder of the engine rotor through the outlet of the detonation tube of the combustor. The process is then repeated, starting again by opening of the cover plate of the flashback assembly to admit a new charge of air and propane, for example when flow of air and propane is again initiated by opening of valves on the air and propane lines based on the monitored timing of the engine rotation.

Figures 14A, 14B, 14C, 14D, 14E:
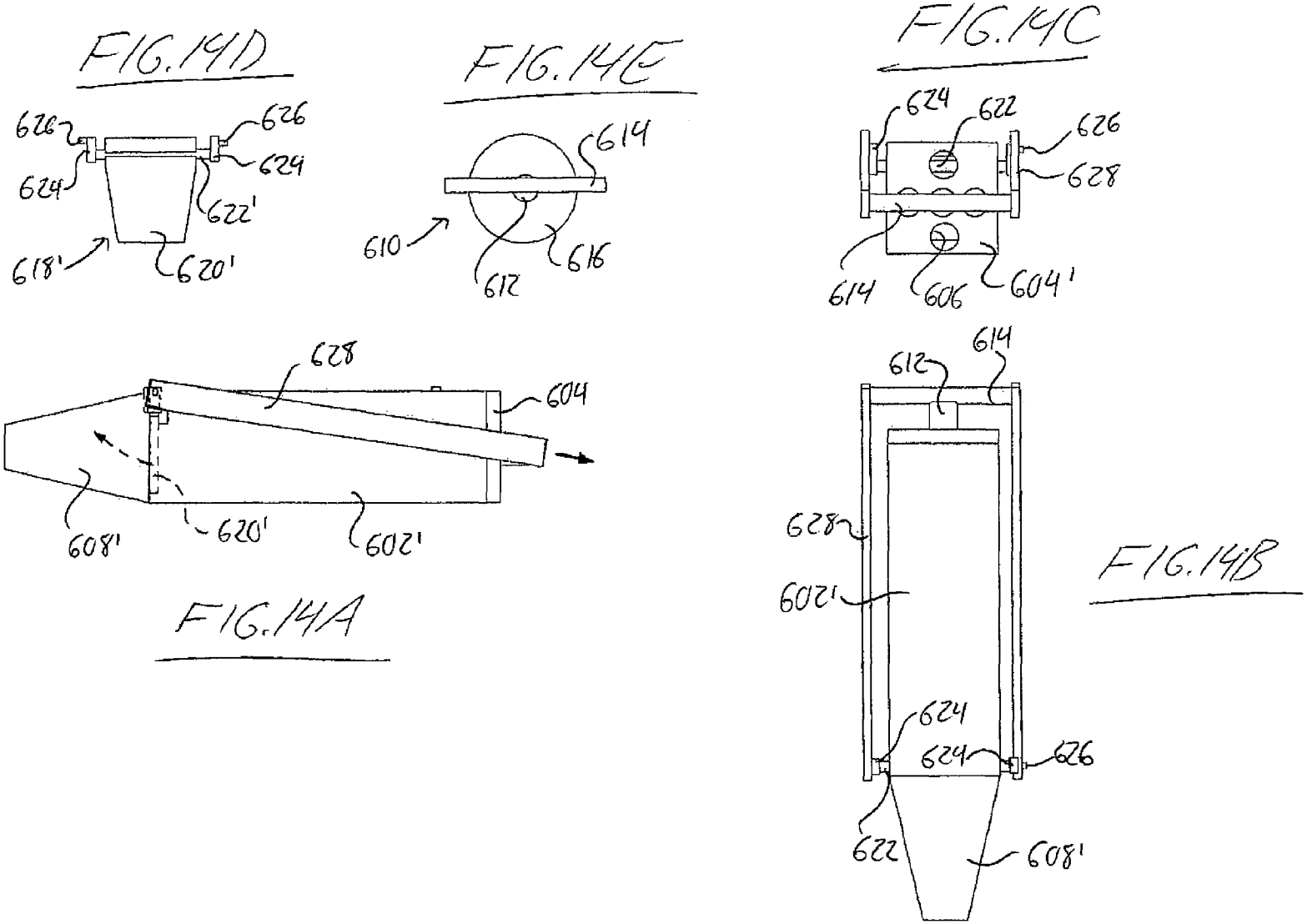
FIGS. 14A, 14B and 14C are side, top and end views of another combustor design that may be used to drive an engine of the present invention, with FIGS. 14D and 14E respectively showing isolated views of a valve and a flashback arrestor of the combustor.

FIG. 14 shows an alternative embodiment of the combustor of FIG. 13. The round combustion cylinder of the preceding embodiment is replaced with a combustion chamber formed of square or rectangular prism shape, for example as formed by a length of square or rectangular tubing. The perforated end plate 604' is thus square or rectangular instead of circular, but the cover plate 616 of the flashback arrestor 610 may be square, rectangular circular or any other shape suitable to fit within the cylinder while covering the openings 606 in the perforated end plate 604'. Instead of a butterfly valve with a swivel axis lying on a midpoint of the combustion chamber height, this embodiment employs a valve plate 620' fixed on a support shaft 620' that crosses the combustion at a position adjacent the top wall thereof, for example leaving 70-percent of the valve plate height in a position suspended from the support shaft. This way, a significant majority of the plate area is disposed to a respective side of the pivotal support shaft 622, whereby the pressure from the combustion will aid in opening the valve, swinging it out of its closed position at the respective end of the combustion chamber. As illustrated by arrows in FIG. 14A, operation of the combustor is otherwise the same, where the combustion causes the flashback stopper to close, thereby pulling on the connecting rods 628, which in turn pull the valve 620' into the open position. Re-establishing air and propane flow into the combustion chamber for a subsequent combustion cycle forces open the flashback arrestor at the inlet end of the combustor, which pushes the connecting rods 628 toward the outlet end of the combustor, and thereby forces the valve plate 620' back into the closed position to seal the combustion chamber closed for filing thereof by the air and propane.

The embodiment of FIG. 14 features a tapered detonation or outlet tube 608' on the outlet end of the combustion chamber instead of the FIG. 13 illustration of a tapered neck 606 and fixed-diameter outlet/detonation tube 608 combination. The illustrated valve plate 20 of the FIG. 14 embodiment is shaped to allow swinging thereof into the tapered outlet tube 608' during movement into the open position. The valve of FIG. 14 may be replaced with a flap valve hinged at the top end thereof for swinging into and out of a sealed position against a suitably shaped valve seat at the outlet end of the combustion chamber, with the shaft of the hinge likewise joined to external legs 24 that form are pinned to the connecting rods 628 for actuating the valve under movement of the flashback arrestor. Either way, the embodiment of FIG. 14 features movement of the valve plate up into an open position substantially flush with top of the of combustor's interior so as to fully or substantially withdrawn from the pathway of the detonation shockwave of the combustor. While reference is made to 'upward' movement of the valve plate toward the 'top' of the combustor interior in describing operation of the combustor in the illustrated orientation thereof, it will be appreciated that the actual direction of movement and the particular side of the combustor at which the valve plate resides when open may vary.

Figure 15:
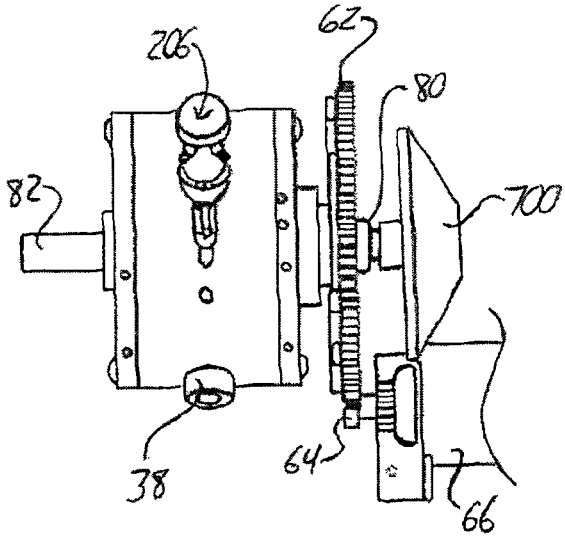
FIG. 15 illustrates installation of a rotating air filter on an engine of the type shown in FIG. 5.

FIG. 15 illustrates installation of a shaft-mounted rotating air filter 700 on the inlet shaft 80 of the engine of the type shown in FIG. 5. The air filter 700 is attached to shaft 80 in a manner such that the filtering media of the air filter overlies the opening of the intake bore 94 in the shaft 80 through which air enters the bottom of the engine cylinders. In the illustrated embodiment, the ring gear 62 driven by the electric starter 66 is mounted on the same shaft 80 as the air filter to reside at a position between the air filter 700 and the ring gear engine housing. As the air filter 700 is mounted on the shaft 80, which in turn is fixed to the rotor of the engine, the filter 700 rotates with the shaft. The filter medium of the air filter may be selected from known types, for example including foam or pleated paper filter types. This rotating air filter may be used as a second filtering stage in an apparatus of the type shown in FIGS. 7 to 9, where a first air filtration device is 406 mounted on the end of the outer housing 400 in which the smaller engine housing is contained. The rotating air filter 700 would thus fit inside the larger surrounding housing 400 of the overall apparatus.

The apparatus illustrated in FIGS. 7 to 9 operates as a power generator and helps to remove carbon from the air. Operation of the apparatus, as used with the rotating air filter of FIG. 15 and the combustor of FIG. 13 or 14, is described as follows. The air and carbon are sucked in through the front of the RPG absorbed by an air filter on the front coupled with a water separator to keep the dampness out. An air filter that spins is also situated on the front of the RPG Eng. Shaft cleans the air even more from dust particles. The air with carbon is being sucked up underneath the pistons as the pistons move out from the centrifugal force, through the valve that also opens with the centrifugal force. Once the piston reaches the firing stage, a new design of a pulse combustor consisting of a combustion area with a spark plug, butterfly valve, a flashback stopper/plunger and a connection rod on the outer side. The air pure oxygen and propane enters the combustor from the Ram Air Turbine, opening the flashback stopper/plunger connected to the butterfly valve, which remains closed trapping the air inside the combustor as the ram air turbine fills the chamber. Once the piston connects the combustion stage, the spark plug fires igniting the mixture, as the ignited mixture expands and combusts the flashback stopper/plunger moves to the closed position which the connection rod is connected to the butterfly valve, and opening it to release all the combustion force.

The combustion force knocks the piston down and rotates the rotor at the same time, the remaining pressure created is directed up towards the Ram Air Turbine to spin it and compress air into the combustor again. The combustion force knocks down the piston, the air and carbon under the piston is being compressed and closes the front side of valve and opening the back side of valve which consists of a carbon steel spring valve (Reed Valve) the air and carbon is compressed out of the cylinder and exits out the back of the engine through the shaft. The compressed air and carbon passes and rotates the Rovak air turbine connected to a generator the remaining air is being passed through a carbon splitting process that will split the carbon from the oxygen molecules holding the carbon molecules in a tube and releasing the oxygen back into the atmosphere again. The remains oxygen being released will have enough force to rotate more Rovak Air Turbines connected to the air coupling exiting the RPG generator.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An engine comprising: a stationary stator defining a cylindrical interior of circular cross section; a cylindrical rotor of circular cross section supported within the stator interior for rotation with a drive shaft projecting from the stator along a central axis, the rotor having a plurality of cylindrical bores extending thereinto from a periphery thereof at angularly spaced positions about the driveshaft;

a respective seal disposed about each cylindrical bore at the periphery of the rotor to seal around the cylindrical bore between the rotor and the stator;

a respective piston disposed within each cylindrical bore and freely slidable therealong;

a pulse detonation combustor having an outlet thereof opening into the interior of the stator, wherein a directional shockwave generated by an expansion of a mixture of ignited air and fuel in the pulse detonation combustor is directed into each cylindrical bore during passage of said cylindrical bore past the outlet of the combustor, wherein the outlet of said pulse detonation combustor is positioned and oriented such that the directional shockwave is directed against a side of the cylindrical bore to drive rotation of the rotor;

an exhaust outtake extending from the interior of the stator to the exterior thereof to discharge exhaust gases from each cylindrical-bore passing by the exhaust outtake under rotation of the rotor after the exertion of the shockwave against the side of said cylindrical bore, the exhaust outtake being circumferentially spaced about the central axis from the pulse detonation combustor.

2. The engine according to any claim 1 wherein a face of each piston facing outward toward the stator curves about the central axis.

3. The engine according to claim 2 wherein each cylindrical bore and the respective piston are arranged to maintain a predetermined rotational orientation of said piston about a longitudinal axis of said cylindrical bore during rotation of the rotor in the predetermined direction to situate the face of said piston in an orientation following an inner surface of the stator against which the seals engage.

4. The engine according to claim 2 wherein the cylindrical bores and pistons are circular in cross-section and one side of each piston has a greater weight than an opposing side of said piston so that said one side will trail said opposing side under rotation of the rotor.

5. The engine according to claim 4 wherein each piston comprises a weight fixed thereto on said one side thereof.

6. The engine according to claim 5 wherein said weight comprises a body of material of greater density than said piston received in a cavity within said piston.

7. The engine according to claim 6 wherein said body of material is a threaded insert and said cavity is a correspondingly threaded bore extending into said piston for threaded receipt of the insert therein.

8. The engine according to claim 1 comprising: a fluid inlet passage extending from outside the stator into the rotor through a first face thereof and communicable with each cylindrical bore through the inner end thereof via a fluid inlet port equipped with a one way inlet valve; a fluid outlet passage closed off from the fluid inlet passage, extending from outside the stator into the rotor through a second face thereof opposite the first face and communicable with each cylindrical bore through the inner end thereof via a fluid outlet port equipped with a one way outlet valve;

whereby fluid is drawn into each cylindrical bore under movement of the respective piston toward the stator and forced out of said cylindrical bore through the fluid outlet passage under subsequent movement of said respective piston toward the inner end of said cylindrical bore when the output from the pulse detonation combustor s exerted against the piston.

9. The engine according to claim 1 wherein the outlet of the combustor extends into the interior of the stator at an oblique angle relative to a radius of the interior of the stator at the location of the outlet around the central axis and relative to a longitudinal axis of each cylindrical bore when said bore is situated at the location of the outlet around the central axis.

10. The engine according to claim 1 comprising a flashback arrestor operably connected to the pulse detonation combustor.

11. A combined engine and compressor comprising:

a stationary stator defining a cylindrical interior of circular cross section;

a cylindrical rotor of circular cross section supported within the stator interior for rotation with a drive shaft projecting from the stator along a central axis, the rotor having a plurality of cylindrical bores extending thereinto from a periphery thereof at angularly spaced positions about the driveshaft;

a respective seal disposed about each cylindrical bore at the periphery of the rotor to seal around the cylindrical bore between the rotor and the stator;

a respective piston disposed within each cylindrical bore and freely slidable therealong; a pulse detonation combustor having an outlet thereof opening into the interior of the stator to direct an output of said pulse detonation combustor into each cylindrical bore during passage of said cylindrical bore past the outlet of the combustor, wherein the outlet of said pulse detonation combustor is positioned and oriented such that the output from the pulse detonation combustor drives the respective piston toward an inner end of the cylindrical bore and a directional shockwave of said output acts against a side of the cylindrical bore drive rotation of the rotor; and an exhaust outtake extending from the interior of the stator to the exterior thereof to discharge exhaust gases from each cylindrical bore passing by the exhaust outtake under rotation of the rotor after the exertion of the output from the pulse detonation combustor against the respective piston in said cylindrical bore, the exhaust outtake being circumferentially spaced about the central axis from the pulse detonation combustor;

a fluid inlet passage extending from outside the stator into the rotor through a first face thereof and communicable with each cylindrical bore through the inner end thereof via a fluid inlet port equipped with a one way inlet valve;

a fluid outlet passage closed off from the fluid inlet passage, extending from outside the stator into the rotor through a second face thereof opposite the first face and communicable with each cylindrical bore through the inner end thereof via a fluid outlet port equipped with a one way outlet valve; and a fluid outlet conduit coupled with the fluid outlet passage; whereby fluid is drawn into each cylindrical bore through the fluid inlet passage under centrifugal movement of the respective piston toward the stator, and then under driving of the piston toward the inner end of the cylindrical bore by the output of the pulse detonation combustor, the fluid is compressed between the piston and the inner end of the cylindrical bore and forced out of said cylindrical bore through the fluid outlet passage.

12. The combined engine and compressor according to claim 11 wherein a shaft on the central axis projects from the rotor to outside the stator and the fluid passages pass axially through said shaft into the rotor.

13. The combined engine and compressor of claim 11 in combination with:

an electrical generator having a rotatable input shaft for production of electricity by the electrical generator under rotation of the input shaft about a rotational axis thereof;

a turbine coupled to the input shaft of the electrical generator and comprising a series of vanes arranged circumferentially around a turbine axis about which the turbine is rotatable; and a nozzle fed from the fluid outlet conduit of the combined engine and compressor and having an outlet oriented in a direction acting on the vanes of the turbine to drive rotation of the turbine and the input shaft of the electrical generator.

14. The combination of claim 13 wherein the nozzle comprises a slit in a tubular member coupled to and fed by the fluid outlet conduit.

15. The combination of claim 13 further comprises a carbon dioxide splitter fed from the fluid outlet conduit of the engine and operable to break down carbon dioxide entering the splitter into carbon and oxygen.

16. The combination of claim 15 wherein the carbon dioxide splitter is located downstream of the turbine.

17. The combination of claim 15 wherein the carbon splitter is connected to an output of the electrical generator for at least partial powering of the carbon splitter thereby.

* * * * *